US007898788B2

(12) United States Patent
Bataille et al.

(10) Patent No.: US 7,898,788 B2
(45) Date of Patent: Mar. 1, 2011

(54) ELECTRONIC CONTROL DEVICE FOR ELECTROMAGNETIC UNIT

(75) Inventors: Christian Bataille, Voiron (FR); Charles Blondel, Grenoble (FR); Philippe Pruvost, Grenoble (FR)

(73) Assignee: Schneider Electric Industries SAS, Rueil-Malmaison (FR)

( * ) Notice: Subject to any disclaimer, the term of this patent is extended or adjusted under 35 U.S.C. 154(b) by 334 days.

(21) Appl. No.: 11/746,891

(22) Filed: May 10, 2007

(65) Prior Publication Data

US 2007/0263337 A1 Nov. 15, 2007

(30) Foreign Application Priority Data

May 15, 2006 (FR) ..... 06 51740

(51) Int. Cl.
*H01H 47/00* (2006.01)
*H01H 9/00* (2006.01)
*H01H 47/32* (2006.01)
*H01H 51/30* (2006.01)

(52) U.S. Cl. ..... 361/152; 361/154

(58) Field of Classification Search ..... 361/152
See application file for complete search history.

(56) References Cited

U.S. PATENT DOCUMENTS 4,980,793 A * 12/1990 Glowczewski et al. ..... 361/154
5,424,637 A 6/1995 Oudyn et al.
2004/0016461 A1 1/2004 Qu et al.
2005/0122117 A1 6/2005 Baurand et al.

FOREIGN PATENT DOCUMENTS

EP 1 039 102 A2 9/2000
WO WO 93/11369 6/1993
WO WO 01/06162 A2 1/2001

* cited by examiner

*Primary Examiner*—Jared Fureman
*Assistant Examiner*—Lucy Thomas
(74) *Attorney, Agent, or Firm*—Oblon, Spivak, McClelland, Maier & Neustadt, L.L.P.

(57) ABSTRACT

An electronic control device for a switch unit, which includes an electromagnetic actuator having a control coil powered by an excitation current for closing a power electrical circuit. The electronic control device includes a storage unit for storing at least one coil control profile which contains a plurality of values representative of the excitation current as a function of respective points of time. A drive unit is connected to the storage unit, and receives at its input an external close command and controls at its output the excitation current at respective points of time from the receipt of the external close command to follow the plurality of excitation current values of said control profile during the closing of the power circuit. The drive unit operates in open loop mode, without using information relating to the switch unit that includes at least a measurement of an excitation current at the control coil.

11 Claims, 1 Drawing Sheet

ELECTRONIC CONTROL DEVICE FOR ELECTROMAGNETIC UNIT

FIELD OF THE INVENTION

Figure 1:
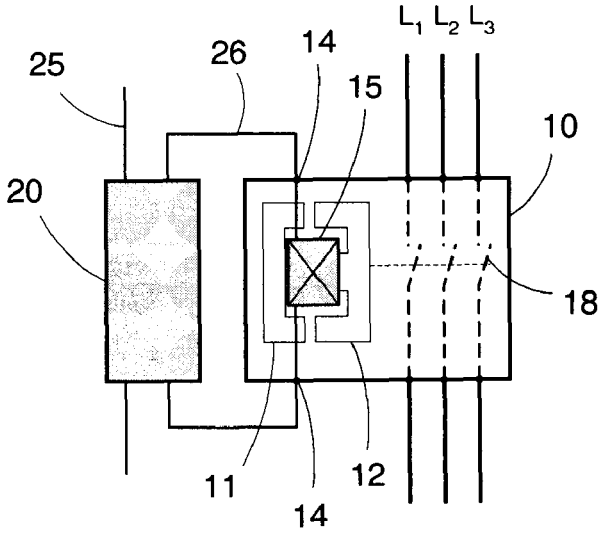

The present invention relates to an electronic control device for the control of a single-pole or multi-pole electromagnetic switch unit, in particular for a unit of the relay, contactor or contactor-breaker type. Such a device can be directly integrated into a switch unit or may be placed on the outside of an existing switch unit.

DISCUSSION OF THE RELATED ART

These switch units normally use an electromagnetic actuator, such as an electromagnet, comprising a mobile part which can be moved under the action of an excitation current flowing in a control coil. Depending on the type of unit, the control coil may or may not belong to the mobile part of the actuator. The mobile part of the actuator is mechanically linked to one or more mobile contacts per pole. The displacement of this mobile part therefore allows this or these mobile contacts to be held against or separated from corresponding fixed contacts, in order to close or open an electrical circuit, called power electrical circuit.

The excitation current received by the coil is generally a control signal of the 'all or nothing' (0/1 or ON/OFF) type, corresponding to a simple control command for opening or closing the contacts of the power circuit. This simple and widely-used solution does not however allow the displacement force applied to the mobile part of the actuator to be varied and optimized during its displacement. The dimensions of the actuator must then often be calculated on the maximum displacement force needed, which leads to a high power consumption and/or a large size of the actuator.

Certain systems already offer simple means allowing the excitation current flowing in the coil to be varied between two values, for example by means of a switchable resistor in the coil control circuit or by means of a coil comprising two switchable control windings in series or in parallel (see document FR2807871) or of two switchable coils. This notably allows the differentiation between a high closing excitation current for the closing action of the circuit and a lower holding excitation current for maintaining the mobile part in the closed position. However, this type of system requires the presence of switching means in the control circuit of the coil and only allows very rudimentary variations in current between closing phase and holding phase.

Systems that operate in closed loop mode also exist, notably in the documents FR2835061 or WO2005017933, in which the position of the mobile part of the actuator is calculated or measured in order to vary the value of the excitation current sent through the coil. Other systems include the measurement of the magnetic flux flowing inside the coil in order to allow this magnetic flux to be regulated (see notably EP0865660).

However, these systems require means for measuring, in real time, a given quantity (position, flux, . . . ), together with means allowing a regulation of the coil control current to be carried out using this measurement, which can imply significant electronic means and high costs.

SUMMARY OF THE INVENTION

For this reason, the subject of the invention is a simple and low-cost electronic control device operating in open loop mode for a dynamic control of the closing motion of an electromagnetic actuator. Advantageously, this simple device does not require any sensor or information input on the switch unit, such as a speed, position, displacement, magnetic flux, coil current or other sensor. It is therefore also very easily usable in association with already-existing units of the relay, contactor or contactor-breaker type. Such a device will allow the performance and the lifetime of these many units to be substantially improved without having to modify them. It can be used with various types of electromagnetic actuators such as permanent magnet voice-coils, or a biased or unbiased reluctance electromagnet.

For this purpose, the invention describes an electronic control device for a switch unit, which comprises an electromagnetic actuator having a control coil powered by an excitation current for closing a power electrical circuit. According to the invention, the control device comprises a storage unit for storing at least one coil control profile, the control profile containing a plurality of values representative of the excitation current as a function of time, and a drive unit connected to the storage unit, receiving at its input an external close command and delivering at its output the said excitation current following the said control profile during the closing of the power circuit.

According to one feature, the device is electrically powered by the external close command, without requiring other sources of power.

According to another feature, the storage unit comprises a non-volatile memory and stores several control profiles. The device comprises selection means connected to the drive unit for selecting one of the said control profiles.

According to another feature, the device is integrated inside the switch unit and the external close command is connected to the coil control terminals of the unit. Alternatively, the device is placed externally to the switch unit and delivers the excitation current to the coil control terminals of the unit.

The invention also describes an electrical switch unit comprising an electromagnetic actuator having a control coil powered by an excitation current for closing a power electrical circuit, and integrating such an electronic control device.

Figure 2:
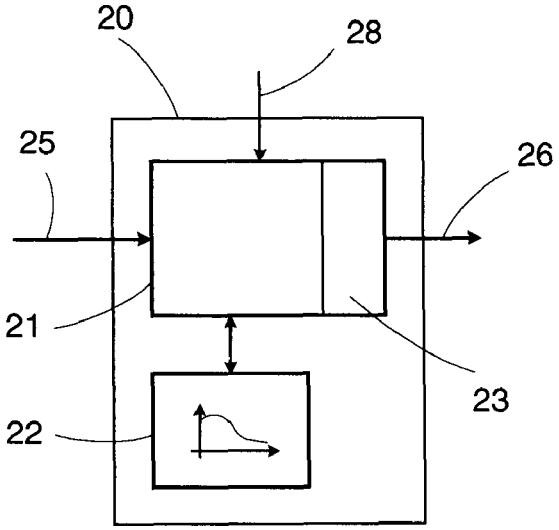
Figure 3:
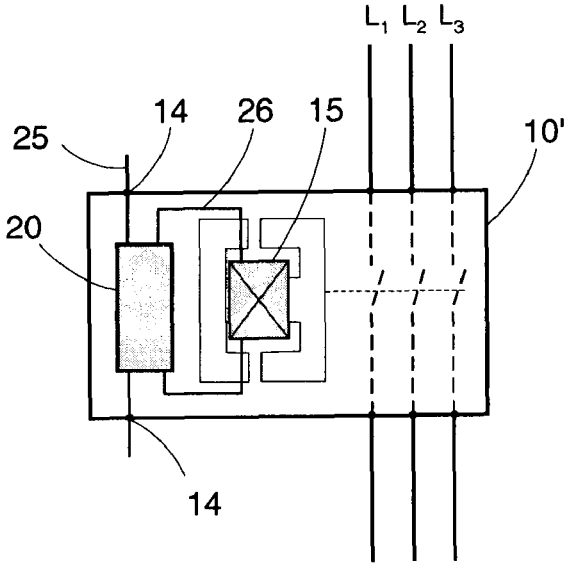

Other features and advantages will become apparent in the detailed description that follows, referring to one embodiment given by way of example and shown in the appended drawings in which:

FIG. 1 shows a simplified example of one embodiment of the invention with an electronic control device external to a switch unit, FIG. 2 details one example of internal structure of the control device, FIG. 3 shows a second example with an electronic control device integrated into a switch unit.

DETAILED DESCRIPTION

With reference to the embodiment in FIG. 1, a multi-pole switch unit 10, of the relay, contactor or contactor-breaker type, is designed to switch a three-phase power circuit L1, L2, L3. The unit 10 comprises an electromagnetic actuator comprising a fixed part 11 and a mobile part 12. The mobile part 12 is mechanically linked to mobile contacts 18 of the power circuit that cooperate with fixed contacts (not shown) in order to switch the power circuit. Whether the unit 10 comprises one or two mobile contacts 18 per phase does not affect the operation.

The electromagnetic actuator also has a control coil 15. When the coil 15 receives an excitation current 26, this causes the mobile part 12 to be displaced in such a manner that the mobile contacts 18 close the electrical power circuit. When the coil 15 no longer receives any excitation current 26, the mobile part 12 then returns to the initial position, thanks normally to return means (such as a return spring) not shown in the figures, and the electrical power circuit opens. FIG. 1 shows the unit 10 in the open position.

FIG. 1 also shows an electronic control device 20 responsible for supplying the unit 10 with an excitation current 26 from an external close command 25. The external close command 25 comes for example from a voltage delivered by an output of automation equipment.

With reference to FIG. 2, the control device 20 comprises a drive unit 21 connected to a storage unit 22. The storage unit 22 stores at least one control profile for the coil 15 of the electromagnetic actuator. A control profile contains various variable values representative of the excitation current as a function of time over at least the duration of the closing action of the mobile part 12. A control profile can for example be in the form of a table giving a set of n pairs of values $V_i$,$T_i$, for sampling values i going from 0 to n. For the sampling value i, $T_i$ represents the time passed since the start time counted for example from the appearance of an external close command 25, and $V_i$ represents the corresponding value of the setpoint of the excitation current 26 to be supplied to the coil at this time $T_i$. This setpoint value $V_i$ is expressed for example in percentage of the value of the nominal excitation current $I_{nom}$ of the coil. The drive unit 21 also comprises a module 23 for current amplification, carried out for example by a servo-amplifier, allowing the signal produced by the values $V_i$ to be amplified and the corresponding excitation current 26, which is sent through the coil 15 of the electromagnetic actuator, to be generated with precision.

Thanks to the stored control profile, the control device 20 is therefore capable of making the value of the excitation current 26 vary at each sampling value i by following the various values $V_i$ of the control profile. A control of the coil excitation current is thus obtained which is a curve of the form I=f(t). A control profile contains setpoint values of the closing current 26 over the duration of the closing action of the power circuit and the setpoint(s) of the holding current 26 to be supplied to the coil 15 in order to remain in the closed state during the hold phase of the power circuit.

A control profile is determined for a given type of electromagnetic actuator. On the other hand, for all the units having an electromagnetic actuator with identical mechanical characteristics, the control profile will be identical for the same application of the switch unit. This device therefore provides a simple means of effecting a dynamic control of the excitation current sent to the coil of the electromagnetic actuator for a given type of actuator, without the requirement for sensors and/or means of regulation.

The curve of the control profile will be able, for example, to impose a high excitation current at the beginning of the closing motion in order to accelerate the starting of the mobile part of the actuator, then a lower excitation current at the end of the closing action in order to slow down the mobile part so as to avoid potential rebounds of the actuator in the closed position and/or to reduce the noise at the moment of closing. Other, more complex, control profiles are of course able to be stored.

Advantageously, the creation of control profiles is previously determined thanks, for example, to the use of simulation software and of modelling. Depending on the mechanical characteristics of the switch unit, a profile of closing speed then a profile of acceleration of the mobile part are determined. A curve of effort to be applied by the actuator in order to follow this acceleration profile, and hence this speed profile, is then obtained by simulation. Depending on the motor characteristics of the actuator, the modelling and simulation programmes then allow the excitation current profile to be obtained that is to be injected into the coil of the actuator as a function of time, in order to obtain the desired effort.

The storage unit 22 comprises, for example, a non-volatile memory of the flash memory type. The storage unit 22 is of course capable of storing several different control profiles, corresponding to various types of electromagnetic actuators and/or to various applications of the switch unit. In this case, selection means can be provided whose job is to supply information 28 to the drive unit 21 allowing the drive unit 21 to select a profile from amongst several stored control profiles in order to deliver an excitation current 26 following the desired profile. The same control device 20 storing several different profiles could then easily be employed for several types of unit 10 and/or of applications thanks to the selection means.

Various selection means may be envisaged in the framework of the invention: either simple local means of the Man-Machine Interface type integrated into the control device 20 (switches, encoder wheels, displays, etc. . . . ), or remote means linked to the drive unit 21 via miscellaneous communication means (bus, network, wireless link, etc. . . . ) in order to supply the selection information 28 to the drive unit 21.

Preferably, the control device 20 is only electrically powered by the external close command 25. In a conventional switch unit, the external command 25 normally supplies a voltage and a current that are high enough in order to directly control the coil 15. The control device 20 is designed so that this voltage and this current supplied are suitable for powering the electronic components of the device 20 when the command 25 is present, in other words during the phases for closing the unit and for holding it in the closed state 10. When the command 25 is not present, in other words during the phases for opening the unit and for holding it in the open state 10, the device 20 is not powered and therefore no longer delivers the excitation current 26 to the coil 15. The actuator then returns to the open position thanks to the return means.

Thus, advantageously, no additional source of power is required in order to power the electronics of the device 20, which contributes to the simplicity of the solution. As an alternative, a continuous source of electrical power for the control device 20 and an additional input supplying the close command to the actuator could however be envisaged.

Whenever a close command 25 occurs, the drive unit 21 is powered up and resets the start time (T=0). It then selects the desired control profile (if several profiles are stored in the storage unit 22) and begins to run through this profile for each sampling time $T_i$ delivering at the output the excitation current 26 determined by means of the corresponding value $V_i$ contained in the control profile.

Advantageously, during the running of the control profile, the drive unit 21 can deliver an excitation current 26 which may be higher than the nominal excitation current $I_{nom}$ of the coil (corresponding for example to a value $V_i$ higher than 100% of the value of $I_{nom}$). For this purpose, the current amplifier 23 comprises an auxiliary device capable of temporarily delivering this current surplus. Such an auxiliary device can, for example, include an auxiliary capacitor and two mini-switches or an electronic current step-up chopper module.

Similarly, in the case of an actuator of the voice-coil type or of a biased reluctance electromagnet, the value of the excitation current 26 can temporarily have a reverse sign (corresponding to a negative value $V_i$). These functionalities allow the accelerations and decelerations of the actuator to be accentuated and hence a much greater flexibility and precision in the control of the actuator to be provided.

FIG. 1 shows a control device 20 which is placed externally to a conventional switch unit 10. Usually, such a unit 10 receives a control command for the coil connected across the coil control terminals 14 of the unit. This coil control command now corresponds to the external close command 25 and is directly connected to the input of the control device 20. The output of the control device 20 delivers the excitation current 26 which is connected to the coil control terminals 14. Thus, if the control profile of the actuator of the coil 10 is known, a control device 20 can easily be placed in order to drive the actuator of any existing unit 10 without any modification of the latter.

As an alternative, FIG. 3 shows a control device 20 which is integrated into a switch unit 10'. The coil control command is then assimilated with the external close command 25 and is directly wired onto the control terminals 14 of the unit.

It will be clearly understood that other variants and improvements in detail may be imagined without straying from the scope of the invention, and that the use of equivalent means may even be envisaged.

The invention claimed is:

1. An electronic control device for a switch unit, which comprises an electromagnetic actuator having a control coil powered by an excitation current for closing a power electrical circuit, wherein said electronic control device comprises:

a storage unit for storing at least one coil control profile, said coil control profile containing a plurality of values representative of the excitation current as a function of respective points of time, wherein each of the plurality of values representative of the excitation current in the control profile is a percentage of a value of a nominal excitation current of the control coil; and a drive unit connected to the storage unit, receiving at its input an external close command and controlling at its output said excitation current at respective points of time from the receipt of the external close command to follow the plurality of excitation current values of said control profile during the closing of the power circuit, the drive unit operating in open loop mode, without using information relating to the switch unit that includes at least a measurement of an excitation current at the control coil.

2. The electronic control device according to claim 1, wherein said electronic control device is electrically powered by the external close command.

3. The electronic control device according to claim 1, wherein the storage unit comprises a non-volatile memory.

4. The electronic control device according to claim 1, wherein the storage unit stores a plurality of coil control profiles corresponding respectively to different types of electromagnetic actuators, and the electronic control device comprises selection means connected to the drive unit for selecting one of the said coil control profiles.

5. The electronic control device according to claim 1, wherein, depending on the coil control profile, the drive unit is capable of temporarily delivering an excitation current of a higher value than the value of the nominal current of the coil.

6. The electronic control device according to claim 1, wherein the drive unit comprises a current amplification module allowing the excitation current to be delivered.

7. The electronic control device according to claim 1, wherein the coil control profile contains a plurality of values representative of the excitation current as a function of time, during the closing action of the power circuit and during the phase for holding the power circuit in the closed state.

8. The electronic control device according to claim 1, wherein the electronic control device is integrated inside the switch unit and that the external close command is connected to the coil control terminals of the unit.

9. The electronic control device according to claim 1, wherein the electronic control device is placed externally to the switch unit and delivers the excitation current to the coil control terminals of the unit.

10. An electronic switch unit comprising an electromagnetic actuator having a control coil powered by an excitation current for closing a power electrical circuit, wherein the unit comprises an electronic control device according to any one of claims 1 to 8.

11. The electronic control device according to claim 1, wherein the control profile is predetermined based on the type of electromagnetic actuator.

* * * * *